United States Patent [19]

Feuchter

[11] Patent Number: 4,745,737

[45] Date of Patent: May 24, 1988

[54] PROCESS FOR THE STOPPING AND RESTARTING OF AN ARRANGEMENT FOR OPEN-END FRICTION SPINNING AND A DEVICE FOR THIS PURPOSE

[75] Inventor: Wolfgang Feuchter, Deggingen Reichenbach, Fed. Rep. of Germany

[73] Assignees: Fritz Stahlecker, Bad Überkingen; Hans Stahlecker, Süssen, both of Fed. Rep. of Germany

[21] Appl. No.: 38,148

[22] Filed: Apr. 14, 1987

[30] Foreign Application Priority Data

Apr. 25, 1986 [DE] Fed. Rep. of Germany ..... 3614032

[51] Int. Cl.[4] ..... D01H 15/02; D01H 1/135

[52] U.S. Cl. ..... 57/263; 57/401

[58] Field of Search ..... 57/400, 401, 261, 263

[56] References Cited

U.S. PATENT DOCUMENTS 4,571,933 2/1986 Stahlecker ..... 57/401

4,606,184 8/1986 Stahlecker et al. ..... 57/263

4,612,762 9/1986 Stahlecker ..... 57/401 X 4,617,792 10/1986 Stahlecker ..... 57/401

4,628,685 12/1986 Stahlecker et al. ..... 57/401 X 4,677,820 7/1987 Stahlecker ..... 57/401

FOREIGN PATENT DOCUMENTS 3416886 11/1985 Fed. Rep. of Germany .

*Primary Examiner*—Donald Watkins

*Attorney, Agent, or Firm*—Barnes & Thornburg

[57] ABSTRACT

A process is provided for operating open-end friction spinning machines of the type including movable friction surface parts defining a yarn forming region and a suction device for creating a suction effect on the yarn forming region. The process includes reducing the suction effect when spinning operations are interrupted, and interrupting the suction device at a point no later than the return of a yarn end into the yarn forming region. An apparatus for performing the process is also provided.

35 Claims, 1 Drawing Sheet

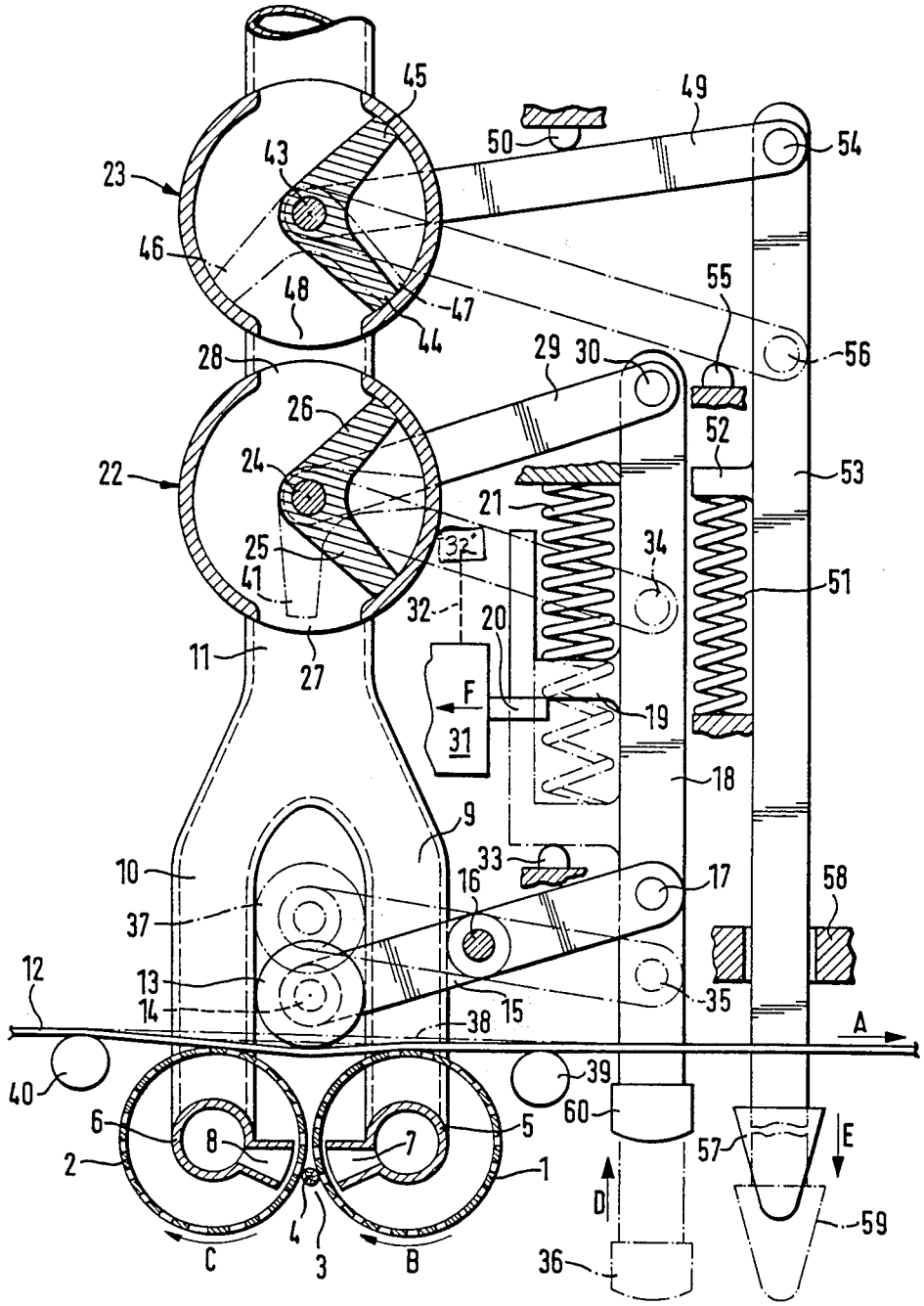
45
49
50
54
23
43
46
48
47
44
55
56
28
29
30
26
52
22
24
53
21
25
34
41
51
32
20
11
27
F
31
19
18
9
10
33
16
17
58
37
12
13
14
15
35
38
A
40
39
60
6
8
7
5
57
E
2
1
D
4
3
C
B
36
59

PROCESS FOR THE STOPPING AND RESTARTING OF AN ARRANGEMENT FOR OPEN-END FRICTION SPINNING AND A DEVICE FOR THIS PURPOSE

BACKGROUND AND SUMMARY OF THE INVENTION

The invention relates to a process for the stopping and restarting of an arrangement for open-end friction spinning having two rollers that are drivable in the same rotational direction and form a wedge-shaped gap serving as the yarn forming zone.

In the case of a known process (DE-OS No. 34 16 886), it is provided that the yarn guard reduces or completely interrupts the suction effect of the suction device in the case of a yarn breakage. The reducing as well as the complete interruption of the suction effect of the suction device have certain problems. If the suction effect is only reduced and not interrupted, the subsequent returning of a yarn end into the area of the wedge-shaped gap causes difficulties for a restarting procedure, particularly if this return of the yarn end is to be carried out by pneumatic means. If, on the other hand, it is provided that the suction effect is completely switched off in the case of a yarn breakage, there is the danger that the fiber residues or the like that are still located in the wedge-shaped gap are twisted together into a yarn worm. Fibers of this yarn worm may be taken out of the wedge-shaped gap by the roller rotating out of the wedge-shaped gap, and brought to or thrown off at a point that is hardly accessible for cleaning.

An object of the invention is to provide a process in which, on the one hand, the return of a yarn end for the restarting is not impaired, while, on the other hand, fiber residues and the like that are still in the wedge-shaped gap are not brought out of the area of the wedge-shaped gap in an uncontrolled way.

This object is achieved by the fact that in the case of a yarn breakage, the suction device is switched in two steps in such a way that until the time of a cleaning of the wedge-shaped gap, the effect of the suction device is reduced. The suction device is then interrupted during the return of the yarn end.

The reduced suction effect is dimensioned in such a way that, on the one hand, it does not pull the fiber residues that are present in the form of a yarn worm into the wedge-shaped gap and jammed in. On the other hand, the suction effect is large enough that the yarn worm is held in the area of the rollers. During or after a cleaning, particularly when the rollers have stopped completely, the suction effect is switched off completely so that it is possible to bring the yarn to be pieced into a piecing position along the wedge-shaped gap by pneumatic means in a simple way.

In other advantageous features of preferred embodiments of the invention, it is provided that, after the return of the yarn end, during the restarting, the effect of the suction device is first reduced, and is subsequently brought to the operational level. The reduced effect of the suction device produces a similar effect on the returned yarn end as the suction air current applied to the yarn worm, i.e., the yarn end to be pieced is neither pulled to deeply into the wedge-shaped gap and jammed nor is it transported out of the area of the wedge-shaped gap by the rollers. It is only subsequently, in the course of the actual piecing, that the operational suction effect is fully restored.

A preferred embodiment of an open-end friction spinning apparatus for carrying out the process is provided which has two friction surface parts that are equipped with a drive and form a yarn forming region. The apparatus includes at least one suction device that generates an air current aimed into the yarn forming region. A suction device control mechanism is provided for reducing the suction effect when spinning operations are interrupted and for interrupting the suction effect no later than a point when a yarn end is returned to the yarn forming region.

In other advantageous features of preferred embodiments of the invention, the suction control mechanism includes a reducing valve device and an interrupting valve device. In preferred embodiments of the invention, the reducing valve device and the interrupting valve device are disposed adjacent one another in an air flow direction between the suction device and a vacuum source.

In certain advantageous features of other preferred embodiments of the invention, the apparatus further includes a yarn guard control device that in the case of a yarn breakage, causes an interruption of the friction surfaces, a stopping of a feeding device which feeds fibers to the yarn forming region and controls the reducing valve device.

In certain advantageous features of other preferred embodiments of the invention, the interrupting valve device includes a given position when in an open position. The interrupting valve device includes an interrupting valve adjusting mechanism for adjusting the given position of the interrupting valve device.

Other objects, advantages and novel features of the present invention will become apparent from the following detailed description of the invention when considered in conjunction with the accompanying drawing.

BRIEF DESCRIPTION OF THE DRAWING

The drawing FIGURE is a partially cross-sectional view of an individual spinning unit of an open-end friction spinning machine.

DETAILED DESCRIPTION OF THE DRAWING

An open-end friction spinning machine includes a plurality of units shown in the drawing that are arranged in a row next to one another, preferably on both sides of the machine, as this is known, for example, from DE-OS No. 34 16 886. Each spinning unit contains two rollers (1, 2), the shells of which are provided with a perforation. The two rollers (1, 2) are driven in the same rotational direction in the direction of the Arrows (B and C) by a tangential belt (12). These rollers (1,2) form a wedge-shaped gap (3) in which fibers that are fed by a feeding device are twisted together into a yarn (4). The twisted yarn (4), is withdrawn in longitudinal direction of the wedge-shaped gap (3) in a way that is not shown in detail. Each of the rollers (1, 2) is disposed on a pipe (5, 6) by roller bearings. The pipes (5, 6) are connected to a vacuum source, and each has a suction slot (7, 8) that is aimed against the area of the fiber-carrying wedge-shaped gap (3) and that extends in longitudinal direction of this wedge-shaped gap (3). Via the suction slots (7, 8), an air current is generated through the shells of the rollers (1, 2) that is aimed into the wedge-shaped gap (3), and by means of which the flying fibers and the forming yarn (4) are kept in the area of the wedge-shaped gap (3).

The two pipes (5, 6) extend out of one of the ends of the rollers (1, 2) and continue by means of pipes (9, 10). At a distance from the rollers (1, 2), pipes (9, 10) combine into a joint suction pipe (11).

The tangential belt (12) passes through in the direction of the Arrow (A) in longitudinal direction of the machine and drives the rollers (1, 2) of all spinning units of at least one side of the machine. This tangential belt (12) moves along directly against the outer shell surfaces of the rollers (1, 2). Between the spinning units, the tangential belt (12) is guided by guide rollers (39, 40) in such a way that it passes close to the rollers (1, 2). In order to drive the rollers (1, 2), the tangential belt (12) is deflected in the area of the rollers (1, 2) by a tension roller (13) toward the rollers (1, 2). The tension roller (13) is freely rotatably disposed on a shaft (14) that is held by a lever (15) that can be pivoted around a shaft (16). With the end facing away from the tension roller (13), the lever (15) is coupled to an actuating rod (18) by a joint (17). Using this arrangement, the tension roller (13) can be pivoted into the position (37) that is shown by a dash-dotted line so that the drive of the rollers (1, 2) is interrupted.

In the connection between the suction pipe (11) and a vacuum source that is not shown, two valves (22, 23) are disposed behind one another. The valve (22) that is preferably manufactured as a reducing valve contains a rotary slide (25, 26) that can be rotated around a shaft (24). In the operating position shown by drawn-out lines, the rotary slide (25, 26) opens up the valve opening (27, 28) and in its second position, shown in dash-dotted lines, partially blocks the valve opening (27). The double-armed slide (25, 26), in a torsionally fixed way, is connected with a lever (29) that via a joint (30) is coupled to the actuating rod (18).

A projection (19) that is loaded by a pressure spring (21) is mounted at the actuating rod (18). The end of the pressure spring opposite the projection is stationarily supported. A stop (20) projects into the moving path of the projection (19) against which the projection (19) is pressed by the pressure spring (21). The stop (20) is part of a control element (31). By actuating the control element (31), the stop (20) can be pulled back in the direction of the Arrow (F) out of the moving path of the projection (19). The spring (21) then pushes the actuating rod (18) and the levers (15) and (29) coupled to it into the inoperative position (36), and the coupling points (30) and (17) into positions (34) and (35), that are shown by a dash-dotted line. Correspondingly, the tension roller (13) arrives in position (37) and the double-armed slide (25, 26) arrives in position (41). In this position, the drive of the rollers (1, 2) is interrupted, and in addition, the effect of the suction device is reduced by the reduction of the cross-section of the valve opening (27).

Via an electric line (32), the control element (31) is connected to a yarn guard 32'. In the case of a yarn breakage, the yarn guide 32' actuates the control element (31) in such a way that the stop (20) is pulled back. In addition, the yarn guard 32' interrupts the fiber feeding by stopping a feeding device that is not shown. After a yarn breakage fiber residues or the like usually remain in the area of the wedge-shaped gap (3) that are twisted together to form a yarn worm corresponding to a yarn (4). The air current, in the area of the wedge-shaped gap (3), that is generated when the rotary slide (25, 26) is in position (41), is therefore dimensioned in such a way that on the one hand, the yarn worm will not be sucked deeper into the wedge-shaped gap (3) which could result in a jamming and damage to the rollers (1, 2) and/or their bearings; and on the other hand, the yarn worm will not be moved out of the area of the wedge-shaped gap (3), particularly by the roller (2) rotating out of the wedge-shaped gap (3). The yarn worm formed by fiber residues or the like therefore is located at a defined, easily accessible point so that when the area of the wedge-shaped gap (3) is cleaned, this yarn worm can be removed easily.

In order to facilitate this cleaning of the wedge-shaped gap (3) and also permit the pneumatic return of a yarn end for a piecing, it is also provided that the suction effect in the area of the wedge-shaped gap (3) can be interrupted completely. This interruption takes place by the second valve (23) that is preferably a stop valve. This valve (23) is equipped with a double-armed rotary slide (44, 45) that can be swivelled around a shaft (43) from the position shown by the drawn-out lines into the position (46, 47) shown by the dash-dotted lines, in which it blocks the valve passage opening (48) completely. The rotary slide (44, 45) is connected in a torsionally fixed way with a lever (49). Via a joint (54), the lever (49) is coupled to an actuating rod (53) that extends to the operating side of the spinning unit, similar to the actuating rod (18). The actuating rod (53) is provided with a projection (52) which engages a pressure spring (51). The end of the pressure spring (51) opposite the actuating rod (53) is stationarily supported. In the shown operating position, the pressure spring (51) forces lever (49) to rest against stop (50) such that the rotary slide (44, 45) is in the shown operating position. Advantageously, the stop (50) is preferably adjustable so that via the position of the rotary slide (44,45), the passage opening of the valve (23) can be adjusted. Through this adjustment, the operational suction effect of the suction device can be adjusted. The end of actuating rod (53) is equipped with a handle part (57) which can be gripped manually or by an automatic piecing device to slide the actuating rod (53) in the direction of the arrow (E), against the effect of the pressure spring (51), into the position (59) shown by the dash-dotted line. In this blocking position, the joint is in position (56). The lever (49) will then rest against a stationary stop (55). The actuating rod (53) is guided so that it can be slid in a guide part (58).

In the case of a yarn breakage, the fiber material feeding device controlled by the yarn guard 32' is stopped first. By the pulling back of the stop (20), the drive of the rollers (1, 2) is interrupted, and the suction effect is reduced by the adjusting of the rotary slide (25, 26) into position (41). During or after a cleaning of the wedge-shaped gap (3), the actuating rod (53) will then be pulled so that the adjusting of the valve (23) will interrupt the suction effect completely. During this condition, a yarn end will then be introduced into a piecing position in the area of the wedge-shaped gap (3). Subsequently, the actuating rod (53) is released so that the reduced suction effect affects the yarn end located in the area of the wedge-shaped gap(3). It is only when, in the course of the continued piecing, the drive of the rollers (1, 2) is switched on again that the operational suction effect is also reached again. The switching-on of the drive of the rollers (1, 2) as well as the switching-on of the full suction effect takes place by pressing the actuating rod (18) in the direction of the arrow (D) so that the stop (20) again comes to rest behind the projection (19).

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. Process for operating an open-end friction spinning unit of the type including:

movable friction surface means defining a yarn forming region;

fiber feeding means for feeding fibers to said yarn forming region; and suction means for creating a suction effect on said yarn forming region;

said process comprising:

feeding fibers to said yarn forming region while creating a suction effect at a first level;

stopping said fiber feeding in response to yarn breakage;

reducing the suction effect from said first level to an intermediate level greater than an interrupted suction effect when said fiber feeding is interrupted; and interrupting said suction means no later than a point when a yarn end is returned to the yarn forming region.

2. Process as in claim 1, further including restarting spinning operations, said restarting including creating a suction effect reduced from said first value and subsequently bringing the suction effect to said first value.

3. Process as in claim 1, further including interrupting the movement of the friction surface means by a yarn guard control device, said yarn guard control device further controlling the suction means.

4. Process as in claim 3, wherein said feeding of fibers is interrupted and controlled by the yarn guard control device.

5. Apparatus for open-end friction spinning comprising:

movable friction surface means defining a yarn forming region;

fiber feeding means for feeding fibers to said yarn forming region;

suction means creating a suction effect on said yarn forming region at a first level during feeding of said fibers to said yarn forming region;

stopping means for stopping said fiber feeding in response to a yarn breakage; and suction control means for reducing the suction effect of the suction means from said first level to an intermediate level greater than an interrupted suction effect when said fiber feeding is interrupted and for interrupting the suction effect of the suction means no later than a point when a yarn end is returned to the yarn forming region.

6. Apparatus as in claim 5, wherein the suction control means includes reducing valve means for reducing the suction effect of the suction means.

7. Apparatus as in claim 5, wherein the suction control means includes interrupting valve means for interrupting the suction effect of the suction means.

8. Apparatus as in claim 6, wherein the suction control means further includes interrupting valve means for interrupting the suction effect of the suction means.

9. Apparatus as in claim 8, wherein the suction means is connected to a vacuum source, creating an airflow direction, said reducing valve means and said interrupting valve means being disposed between the suction means and the vacuum source.

10. Apparatus as in claim 9, wherein the reducing valve means and the interrupting valve means are arranged adjacent one another in the airflow direction.

11. Apparatus as in claim 6, further including yarn guard control means for controlling the reducing valve means.

12. Apparatus as in claim 8, further including yarn guard control means for controlling the reducing valve means.

13. Apparatus as in claim 12, wherein the interrupting valve means is controlled independently from the reducing valve means.

14. Apparatus as in claim 8, further including operation control means for interrupting the drive of the friction surface means, said operation control means further controlling the reducing valve means.

15. Apparatus as in claim 14, further including coupling means for coupling the control of the reducing valve means and the interruption of the drive of the friction surface means.

16. Apparatus as in claim 8, further including interrupting valve adjusting means for adjusting the interrupting valve means.

17. Apparatus as in claim 8, wherein the interrupting valve means includes a given position when in an open position, said interrupting valve means including interrupting valve adjusting means for adjusting the given position of the interrupting valve means.

18. Apparatus as in claim 17, wherein the interrupting valve means includes a rotary slide valve mechanism.

19. Apparatus as in claim 18, wherein the reducing valve means includes a rotary slide valve mechanism.

20. Apparatus for open-end friction spinning comprising:

movable friction surface means defining a yarn forming region;

suction means creating a suction effect on said yarn forming region;

suction control means for reducing the suction effect of the suction means when spinning operations are interrupted and for interrupting the suction effect of the suction means no later than a point when a yarn end is returned to the yarn forming region, said suction control means including reducing valve means for reducing the suction effect of the suction means and interrupting valve means for interrupting the suction effect of the suction effect.

21. Apparatus as in claim 20, wherein the suction means is connected to a vacuum source, creating an airflow direction, said reducing valve means and said interrupting valve means being disposed between the suction means and the vacuum source.

22. Apparatus as in claim 21, wherein the reducing valve means and the interrupting valve means are arranged adjacent one another in the airflow direction.

23. Apparatus as in claim 20, further including yarn guard control means for controlling the reducing valve means.

24. Apparatus as in claim 23, wherein the interrupting valve means is controlled independently from the reducing valve means.

25. Apparatus as in claim 20, further including operation control means for interrupting the drive of the friction surface means, said operation control means further controlling the reducing valve means.

26. Apparatus as in claim 25, further including coupling means for coupling the control of the reducing valve means and the interruption of the drive of the friction surface means.

27. Apparatus as in claim 20, further including interrupting valve adjusting means for adjusting the interrupting valve means.

28. Apparatus as in claim 20, wherein the interrupting valve means includes a given position when in an open position, said interrupting valve means including interrupting valve adjusting means for adjusting the given position of the interrupting valve means.

29. Apparatus as in claim 28, wherein the interrupting valve means includes a rotary slide valve mechanism.

30. Apparatus as in claim 29, wherein the reducing valve means includes a rotary slide valve mechanism.

31. Process as in claim 4, wherein said yarn guard control device detects yarn breakage and stops the fiber feeding in response to said yarn breakage.

32. Process as in claim 31, further including cleaning said spinning units with a movable servicing apparatus, said interrupting of said suction means being initiated by said movable servicing apparatus.

33. Process as in claim 32, further including restarting spinning operations at a spinning unit after said interrupting of said suction means, said restarting of spinning operations including returning a yarn end to said yarn forming region by said movable servicing apparatus.

34. Apparatus as in claim 5, further including yarn guard detection means for detecting yarn breakage and for stopping said fiber feeding means in response to said yarn breakage.

35. Apparatus as in claim 34, further including a movable servicing apparatus for carrying out cleaning operations at said spinning units, said movable servicing apparatus including switching means for initiating the interrupting of said suction means suction effect and including yarn end returning means for returning a yarn end to said yarn forming region for restarting spinning operations.

* * * * *